US006425167B1

(12) United States Patent
Barbarite et al.

(10) Patent No.: US 6,425,167 B1
(45) Date of Patent: Jul. 30, 2002

(54) CLOTHING ACCESSORY CLIP

(76) Inventors: Anthony S. Barbarite; Carolyn M. Barbarite, both of 14 Erita La., New York, NY (US) 11787-1305

( * ) Notice: Subject to any disclaimer, the term of this patent is extended or adjusted under 35 U.S.C. 154(b) by 29 days.

(21) Appl. No.: 09/592,047

(22) Filed: Jun. 12, 2000

(51) Int. Cl.[7] ..... A44B 21/00
(52) U.S. Cl. ..... 24/298; 24/3.13
(58) Field of Search ..... 24/298, 300, 301, 24/302, 3.13; 248/499, 500; 224/268, 269; 223/85, 97; 2/160, 304, 323, 326

(56) References Cited

U.S. PATENT DOCUMENTS 520,053 A * 5/1894 Hopkins
1,009,522 A * 11/1911 Hunter
1,683,545 A * 9/1928 Harris
2,432,957 A * 12/1947 Webster
2,652,567 A * 9/1953 Fisher
3,657,774 A * 4/1972 Reynolds
4,361,934 A * 12/1982 Darnell
4,779,778 A * 10/1988 Nixon, II
5,109,578 A * 5/1992 Cox
5,230,451 A * 7/1993 Onozawa
5,351,346 A * 10/1994 Hodges, Jr.
5,722,125 A * 3/1998 Vasilopoulos
6,070,303 A * 6/2000 Macy et al.
6,073,714 A * 6/2000 Wyenn

* cited by examiner

*Primary Examiner*—James R. Brittain
(74) *Attorney, Agent, or Firm*—Galgano & Burke

(57) ABSTRACT

A clothing accessory clip includes a plurality of elongate cords, each attached at one end to a central support, and each having its free end attached to a fastening device. According to the presently preferred embodiment, one of the fastening devices is a hook for attaching to the ring of a jacket and the other fastening devices are spring biased clips for attaching to a neck gator, goggles, a hat, and a pair of gloves or mittens. The cords are preferably made of a braided cord material and the central support is preferably plastic. The hook is preferably a lanyard hook and the spring biased clips are preferably "alligator" type clips.

4 Claims, 1 Drawing Sheet

CLOTHING ACCESSORY CLIP

BACKGROUND OF THE INVENTION

1. Field of the Invention

The invention relates to an apparatus for attaching articles of clothing to one another. More particularly, the invention relates to a clip device for attaching clothing accessories such as a hat, neck gator, goggles, and gloves to a jacket, and for use after the winter activity to hang all articles together for storage purposes. The invention also is designed to hang independently on a hanger or coat rack.

2. State of the Art

There are known devices for attaching articles of clothing to one another. However, these devices generally only attach two articles of clothing to each other, for example, a pair of gloves or a pair of socks.

Parents of young children, particularly parents of several young children, know the difficulty of keeping children's clothing accessories together. Winter clothing, in particular, is often misplaced. This is evident when a family goes on a skiing trip. Children often misplace a neck gator, goggles, a hat, or one or more gloves or mittens. When a child misplaces an article of clothing, it delays the entire family outing while the misplaced article of clothing is located.

While it is generally known to attach ski gloves or mittens to a ski jacket using clips, it is not known to attach other articles of clothing such as a hat, a neck gator, and goggles to a jacket. It is also not known to have several articles of clothing attached to an accessory clip for safe keeping and convenient access.

SUMMARY OF THE INVENTION

It is therefore an object of the invention to provide an apparatus for securing several articles of clothing to each other.

It is also an object of the invention to provide an apparatus for securing two gloves or mittens as well as a hat, neck gator, and goggles to a jacket.

It is another object of the invention to provide an apparatus for securing several articles of clothing to each other which will enable people to locate all necessary articles of clothing conveniently.

It is still another object of the invention to provide an apparatus for securing several articles of clothing to each other which is inexpensive to manufacture.

In accord with these objects which will be discussed in detail below, the clothing accessory clip of the present invention includes a plurality of elongate bands, each attached at one end to a central support, and each having its free end attached to a fastening device. According to the presently preferred embodiment, one of the fastening devices is a hook for attaching to the ring of a jacket and the other fastening devices are spring biased clips for attaching to a scarf, a hat, and a pair of gloves or mittens. The bands are preferably made of a woven cloth material and the central support is preferably a metal or plastic ring. The hook is preferably a spring hook and the spring biased clips are preferably "alligator" type clips.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
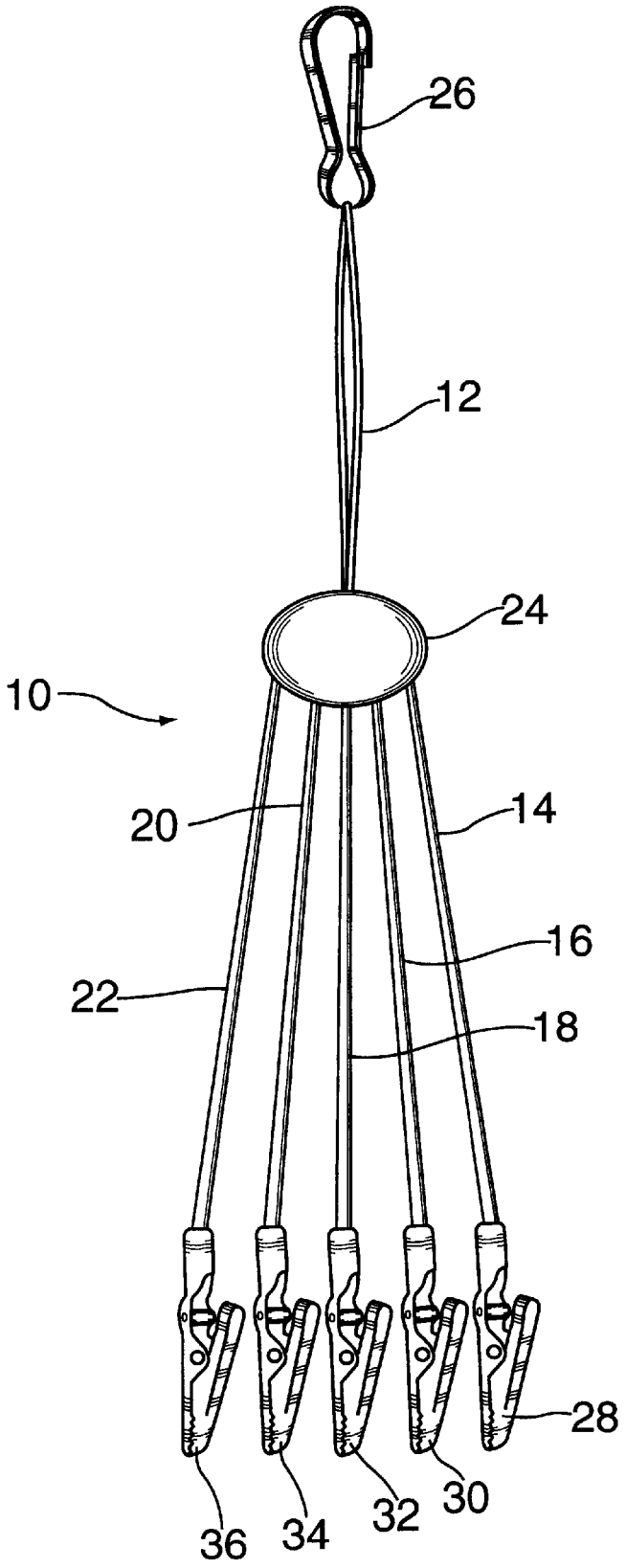
FIG. 1 is a side elevational view of the presently preferred embodiment of the invention.

Referring now to FIG. 1, the clothing accessory clip 10 of the present invention includes a plurality of elongate bands 12, preferably braided cords 14, 16, 18, 20, 22, each attached at one end to a central ring support 24, preferably a plastic generally disc-shaped member and each having its free end attached to a fastening device 26, 28, 30, 32, 34, 36. According to the presently preferred embodiment, one of the fastening devices 26 is a hook for attaching to the ring of a jacket or for attaching it to a storage support (such as an eyelet provided on a wall in a storage closet or the like). The other fastening devices 28, 30, 32, 34, 36 are spring biased clips for attaching to a neck gator, a hat, goggles, and a pair of gloves or mittens, etc. As shown in the Figure, there are five spring biased clips 28, 30, 32, 34, 36 for attaching to a neck gator, a hat, goggles, and a pair of gloves or mittens, plus one other item, for example a second scarf.

The braided cords 12, 14, 16, 18, 20, 22, are preferably made of a woven cloth material and the central support 24 is preferably a metal or plastic ring generally flat oval or circular central support 24 in which the inner ends of the cords are embedded. The hook 26 is preferably a lanyard hook and the spring biased clips 28, 30, 32, 34, 36 are preferably "alligator" type clips. The braided cord 12 is preferably in the form of a loop on which the hook is mounted.

There has been described and illustrated herein a preferred embodiment of a clothing accessory clip. While a particular embodiment of the invention has been described, it is not intended that the invention be limited thereto, as it is intended that the invention be as broad in scope as the art will allow and that the specification be read likewise. Thus, while particular fastening clips have been disclosed, it will be appreciated that other fastening clips could be utilized. Also, while braided cloth material has been described for the cords, it will be recognized that other types of material could be used with similar results obtained. Moreover, while particular configurations have been disclosed in reference to the central support or hub, it will be appreciated that other configurations could be used as well. Furthermore, while the clothing accessory clip has been disclosed as having one hook and five spring fasteners, it will be understood that more or fewer fasteners can achieve the same or similar function as disclosed herein provided however, that a sufficient number are provided to secure several articles of clothing to each other. It will therefore be appreciated by those skilled in the art that yet other modifications could be made to the provided invention without deviating from its spirit and scope as so claimed.

What is claimed is:

1. A clothing accessory clip, comprising:

a) a multiplicity of elongate bands, each having a first and second end;

b) a plastic central support, the first end of each of said elongate bands being embedded in said central support and both ends of one of said elongate bands being embedded in said central support so as to form a loop;

c) a multiplicity of fastening devices one of which is received on said loop and others of which are attached to the second ends of the other of said bands, wherein one of said fastening devices is a hook adapted to attach to a ring which hook is received on said loop and the others of said fastening devices includes at least three, spring-biased alligator clips adapted to attach to one of a plurality of clothing accessories.

2. A clothing accessory clip according to claim 1, wherein said bands are braided cords.

3. A clothing accessory clip according to claim 2, wherein said braided cords are made of a cloth material.

4. A clothing accessory clip according to claim 1, wherein said hook is a lanyard hook.

* * * * *